US006814421B2

(12) United States Patent
Maher

(10) Patent No.: US 6,814,421 B2
(45) Date of Patent: Nov. 9, 2004

(54) PRINTING DEVICE AND METHOD

(75) Inventor: Edward P. Maher, Oceanside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 2 days.

(21) Appl. No.: 10/279,693

(22) Filed: Oct. 24, 2002

(65) Prior Publication Data

US 2004/0080564 A1 Apr. 29, 2004

(51) Int. Cl.[7] ..... B41J 2/165

(52) U.S. Cl. ..... 347/22; 347/29; 347/30; 347/33; 347/35

(58) Field of Search ..... 347/22, 29, 30, 347/32, 33, 35, 13, 42

(56) References Cited

U.S. PATENT DOCUMENTS

| | | | |
|---|---|---|---|
| 5,057,854 | A | 10/1991 | Pond et al. |
| 5,094,554 | A | 3/1992 | Hurd et al. |
| 5,160,945 | A | 11/1992 | Drake |
| 5,192,959 | A | 3/1993 | Drake et al. |
| 5,206,666 | A | 4/1993 | Watanabe et al. |
| 5,257,043 | A | 10/1993 | Kneezel |
| 5,257,044 | A | 10/1993 | Carlotta et al. |
| 5,270,738 | A | 12/1993 | Takahashi et al. |
| 5,280,308 | A | 1/1994 | Takahashi et al. |
| 5,334,897 | A | 8/1994 | Ineson et al. |
| 5,367,326 | A | 11/1994 | Pond et al. |
| 5,428,375 | A | 6/1995 | Simon et al. |
| 5,572,244 | A | 11/1996 | Drake et al. |
| 5,587,730 | A | 12/1996 | Karz |
| 5,610,640 | A | 3/1997 | Anderson et al. |
| 5,710,582 | A | 1/1998 | Hawkins et al. |
| 5,757,387 | A | 5/1998 | Manduley |
| 5,784,077 | A | 7/1998 | Silverbrook |
| 5,838,343 | A | 11/1998 | Chapin et al. |
| 5,889,535 | A | 3/1999 | Jackson et al. |
| 5,933,163 | A | 8/1999 | Koizumi et al. |
| 6,089,693 | A | 7/2000 | Drake et al. |
| 6,155,669 | A | 12/2000 | Donahue et al. |
| 6,172,691 | B1 | 1/2001 | Belon et al. |
| 6,183,059 | B1 | 2/2001 | Muhl et al. |
| 6,224,187 | B1 | 5/2001 | Inten et al. |
| 6,296,648 | B1 | 10/2001 | Boche et al. |
| 6,310,640 | B1 | 10/2001 | Askeland |
| 6,325,488 | B1 | 12/2001 | Beerling et al. |
| 6,350,011 | B1 | 2/2002 | Karlinski |
| 6,371,672 | B1 | 4/2002 | Pirie et al. |
| 6,375,296 | B1 | 4/2002 | McGarry et al. |
| 6,382,766 | B1 | 5/2002 | Park |
| 6,382,767 | B1 | 5/2002 | Greive |
| 6,402,288 | B2 | 6/2002 | Rhodes et al. |
| 6,402,290 | B1 | 6/2002 | Johnson et al. |
| 6,409,306 | B1 | 6/2002 | Shiida |
| 6,422,679 | B1 | 7/2002 | Aldrich |
| 6,435,640 | B1 | 8/2002 | Yamaguchi |
| 6,457,800 | B1 | 10/2002 | Bohm et al. |
| 6,471,331 | B1 | 10/2002 | Silverbrook et al. |
| 6,585,347 | B1 * | 7/2003 | Johnson et al. ..... 347/22 |
| 2001/0038401 | A1 | 11/2001 | Kawase et al. |
| 2002/0018097 | A1 | 2/2002 | Kitahara et al. |
| 2002/0024557 | A1 | 2/2002 | Matsumoto et al. |
| 2002/0044168 | A1 | 4/2002 | Hashi et al. |
| 2002/0126176 | A1 | 9/2002 | Nishi et al. |
| 2002/0167563 | A1 | 11/2002 | Sawyer et al. |
| 2002/0171708 | A1 | 11/2002 | Watanabe et al. |

FOREIGN PATENT DOCUMENTS

| | | |
|---|---|---|
| EP | 0676288 | 10/1995 |
| EP | 0845360 | 6/1998 |
| EP | 1302322 | 4/2003 |

* cited by examiner

*Primary Examiner*—Shih-Wen Hsieh

(57) ABSTRACT

In accordance with one embodiment, a printing device includes a plurality of print cartridges arranged in an array. The printing device also includes a plurality of modular cleaning units for servicing the plurality of print cartridges, the modular cleaning units being arranged to allow the plurality of print cartridges to be serviced simultaneously.

30 Claims, 6 Drawing Sheets

PRINTING DEVICE AND METHOD

BACKGROUND

Ink jet printing systems typically operate by applying ink from one or more print cartridges onto a print media such as paper. The print cartridges contain multiple nozzles that may be controlled to selectively eject ink. Servicing the print cartridges may allow such printing systems to function more reliably and produce higher quality images. In some applications, such as those utilizing multiple print cartridges, servicing the print cartridges becomes difficult. A need therefore exists for servicing multiple print cartridges.

DETAILED DESCRIPTION OF THE PREFERRED EMBODIMENTS

In accordance with various embodiments, a modular cleaning unit is provided and functions to service individual print cartridges. The modular cleaning unit may provide one or more of the functions of wiping, receiving ink ("spitting"), and capping.

The modular cleaning unit may be a freestanding unit for servicing a single print cartridge. The cleaning unit may also be configured wherein multiple cleaning units are grouped together for simultaneously cleaning multiple print cartridges in a particular printing device. By servicing the print cartridges, the printing device is less likely to malfunction and is better able to produce high quality images. Other advantages will be apparent to those of skill in the art.

Figure 1:
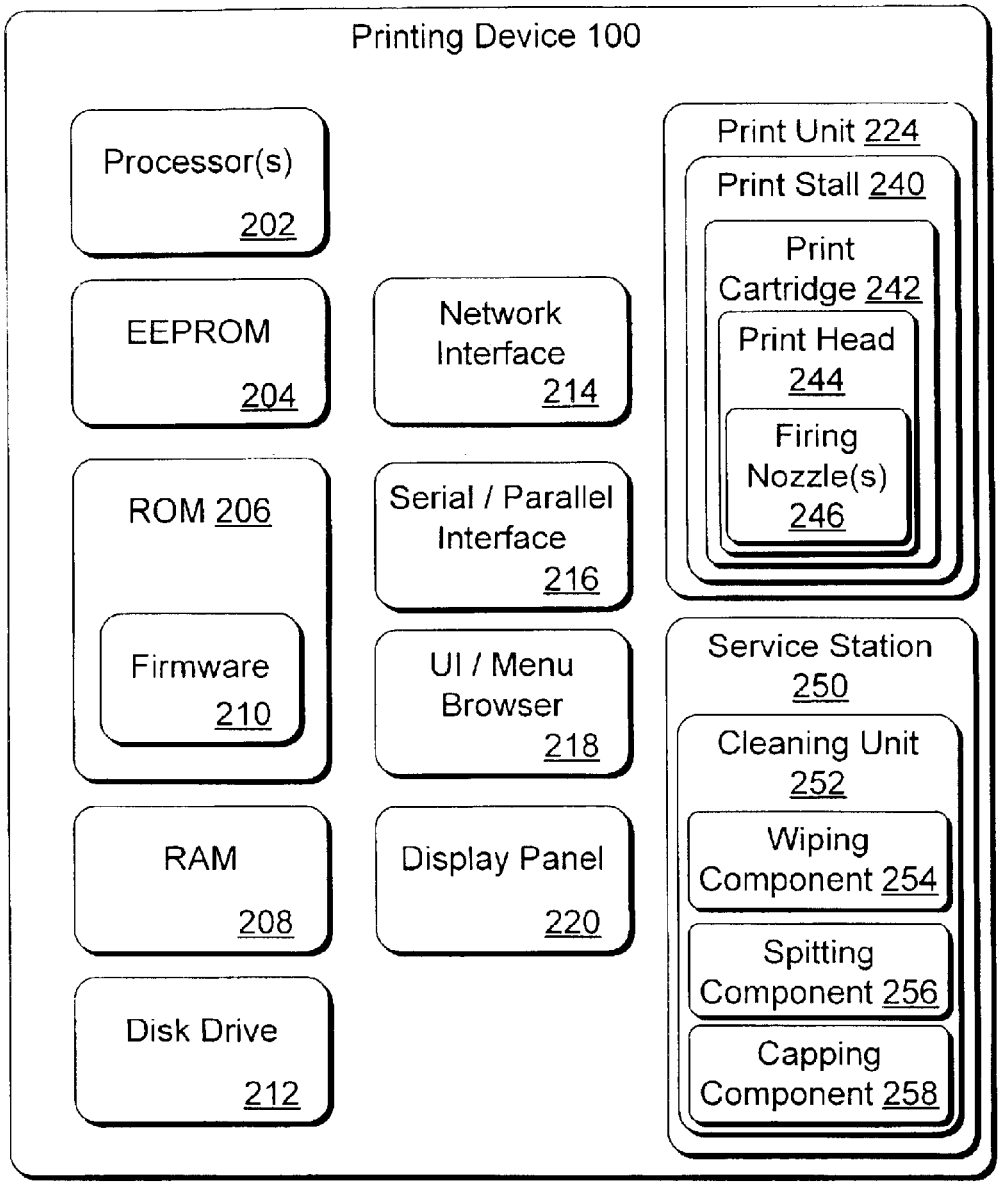
FIG. 1 shows a block diagram that illustrates various components of an exemplary printing device in accordance with one embodiment.

FIG. 1 illustrates various components of an exemplary printing device 100. Printing device 100 may include one or more controllers that are embodied as one or more processors 202 to control various printing operations, such as media handling and ink ejection.

Printing device 100 may have an electrically erasable programmable read-only memory (EEPROM) 204, ROM 206 (non-erasable), and a random access memory (RAM) 208. Although printing device 100 is illustrated having an EEPROM 204 and ROM 206, a particular printing device may only include one of the memory components. Additionally, although not shown, a system bus may connect the various components within the printing device 100.

The printing device 100 may also have a firmware component 210 that is implemented as a permanent memory module stored on ROM 206. The firmware 210 is programmed and tested like software, and is distributed with the printing device 100. The firmware 210 may be implemented to coordinate operations of the hardware within printing device 100 and contains programming constructs used to implement such operations.

Processor(s) 202 process various instructions to control the operation of the printing device 100 and to communicate with other electronic and computing devices. The memory components, EEPROM 204, ROM 206, and RAM 208, store various information and/or data such as configuration information, fonts, templates, data being printed, and menu structure information. Although not shown, a particular printing device may also include a flash memory device in place of or in addition to EEPROM 204 and ROM 206.

Printing device 100 may also include a disk drive 212, a network interface 214, and a serial/parallel interface 216. Disk drive 212 provides additional storage for data being printed or other information maintained by the printing device 100. Although printing device 100 is illustrated having both RAM 208 and a disk drive 212, a particular printing device may include either RAM 208 or disk drive 212, depending on the storage needs of the printer. For example, some printing devices may include a small amount of RAM 208 and no disk drive 212, thereby reducing the manufacturing cost of the printing device.

Network interface 214 provides a connection between printing device 100 and a data communication network. The network interface 214 allows devices coupled to a common data communication network to send print jobs, menu data, and other information to printing device 100 via the network. Similarly, serial/parallel interface 216 provides a data communication path directly between printing device 100 and another electronic or computing device. Although printing device 100 is illustrated having a network interface 214 and serial/parallel interface 216, a particular printing device may only include one such interface component.

Printing device 100 may also include a user interface and menu browser 218, and a display panel 220. The user interface and menu browser 218 allow a user of the printing device 100 to navigate the printing device's menu structure. User interface 218 may be implemented as indicators or a series of buttons, switches, or other selectable controls that are manipulated by a user of the printing device. Display panel 220 is a graphical display that provides information regarding the status of the printing device 100 and the current options available to a user through the menu structure.

Printing device 100 also includes a print unit 224 that includes mechanisms arranged to selectively apply ink (e.g., liquid ink) to a print media such as paper, plastic, fabric, and the like in accordance with print data corresponding to a print job.

Print unit 224 may comprise a print stall 240 and a print cartridge 242. A print stall is a structure or mechanism that holds a print cartridge in a desired orientation. A print cartridge 242 positioned in a print stall 240 may be referenced as a "print cartridge assembly", as will be discussed below. In the operation of printing device 100, the print stall in the illustrated and described embodiments may be stationary and the print media moved relative to the print stall. Such need not, however, always be the case. For example, in some embodiments, the stall may move in addition to, or alternatively to, the print media being moved.

Individual print cartridges 242 may comprise a print head 244 that has a plurality of firing nozzles 246 through which ink is ejected. The firing nozzles 246 are fired individually to deposit drops of ink onto the print media according to data that is received from the processor 202. As an example, the print head 244 might have firing nozzles 246 that number into the hundreds. A "firing" is the action of applying a firing pulse or driving voltage to an individual firing nozzle 246 to cause that firing nozzle to eject an ink drop or droplet.

The printing device 100 may also comprise a service station 250 that includes one or more cleaning units 252 for servicing the print cartridges 242. Individual cleaning units 252 may include a wiping component 254, a fluid receiving "spitting" component 256, and a capping component 258.

The wiping component 254 may clean or wipe material from a surface of the print head 244 through which ink is ejected from the firing nozzles 246. The wiping component 254 may remove materials such as ink droplets that have accumulated on the print head, as well as foreign material such as paper fibers from the print media.

The spitting component or "spittoon" 256 allows ink to be cleared from the firing nozzles 246 to prevent clogging. The capping component 258 may selectively cover and seal nozzle 246 to reduce drying of the firing nozzles 246 when the print cartridge 242 is not in use.

Figure 2:
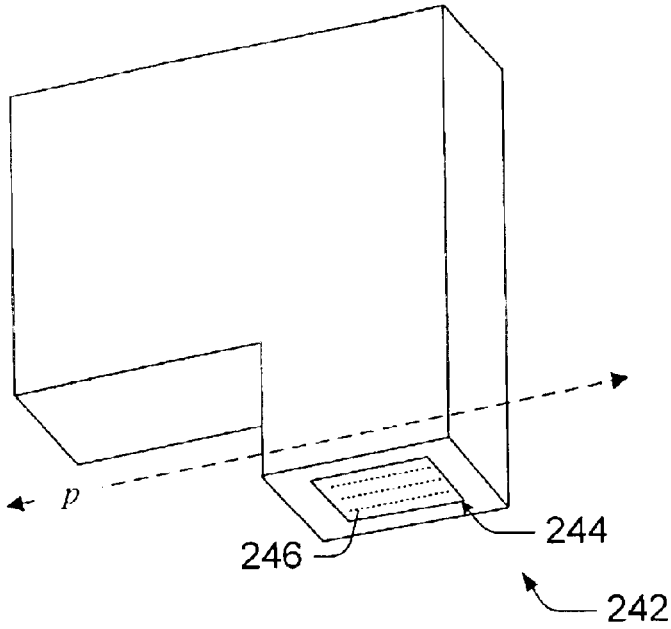
FIG. 2 shows an exemplary print cartridge in accordance with one embodiment.
Figure 2A:
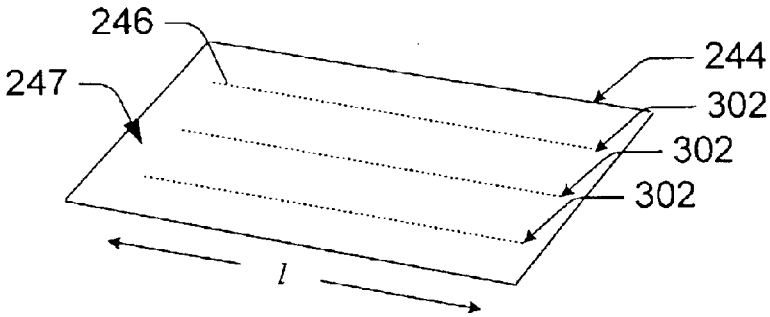
FIG. 2*a* shows an enlarged portion of the exemplary print cartridge shown in FIG. 2.

FIG. 2 shows a perspective view of an exemplary print cartridge 242, such as an ink jet print cartridge. FIG. 2*a* shows an enlarged view of a portion of the print cartridge. The print cartridge 242 can function as an image forming means to allow a printing device to form a desired image. The print cartridge has a generally planar print head 244 through which a plurality of firing nozzles 246 are arranged. Generally, the print head 244 defines a bottom surface of the print cartridge 242 and is disposed proximate the print media on which an image is intended to be printed.

The firing nozzles 246 may be arranged in one or more linear, or generally linear, nozzle array(s) 302 (shown FIG. 2*a*). By way of example, and as shown in FIG. 2*a,* the firing nozzles 246 are arranged in three generally linear and generally parallel nozzle arrays 302. Each of the three nozzle arrays 302 may be oriented generally parallel to a long axis of the print cartridge 242. For example, a long axis of the print cartridge may be seen in FIG. 2 and is designated as "p".

The nozzles arrays 302 have a length l that may represent a maximum print coverage swath attainable by the print cartridge 242. An image that is wider than the print coverage swath may be formed in various ways such as moving either or both the print cartridge and the print media relative to the other, to allow adjacent swaths to be completed. Other suitable configurations will be described in more detail below in relation to FIG. 5.

Figure 3:
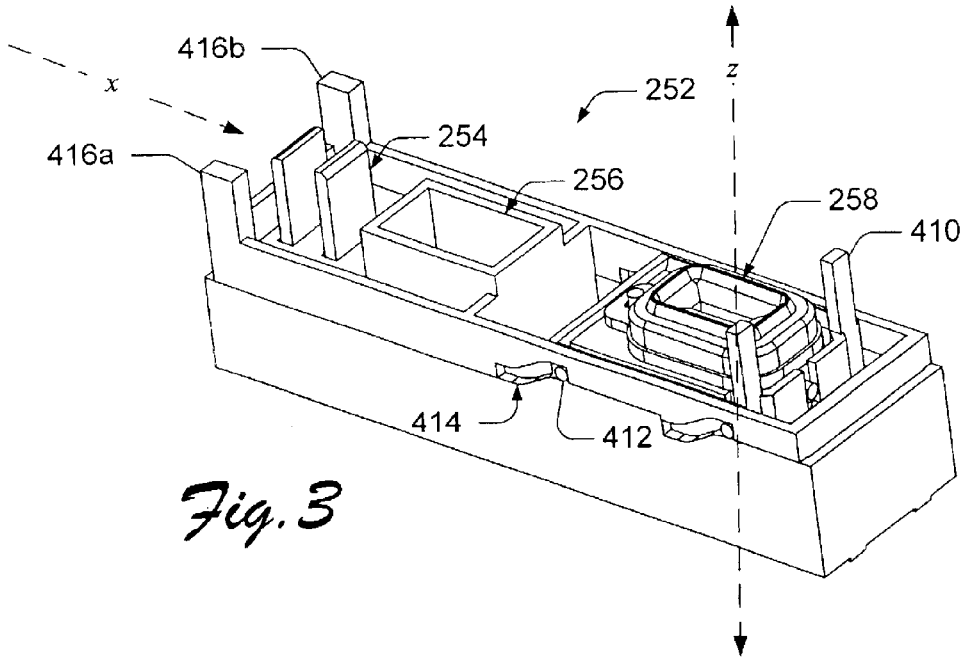
FIGS. 3–3*a* illustrate an exemplary cleaning unit in accordance with one embodiment.
Figure 3A:
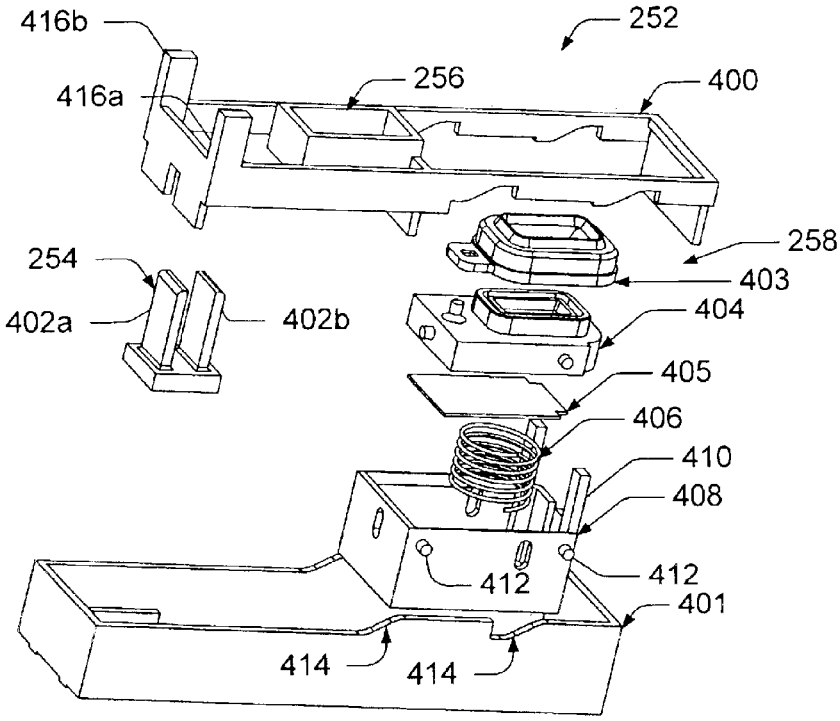
Figure 4:
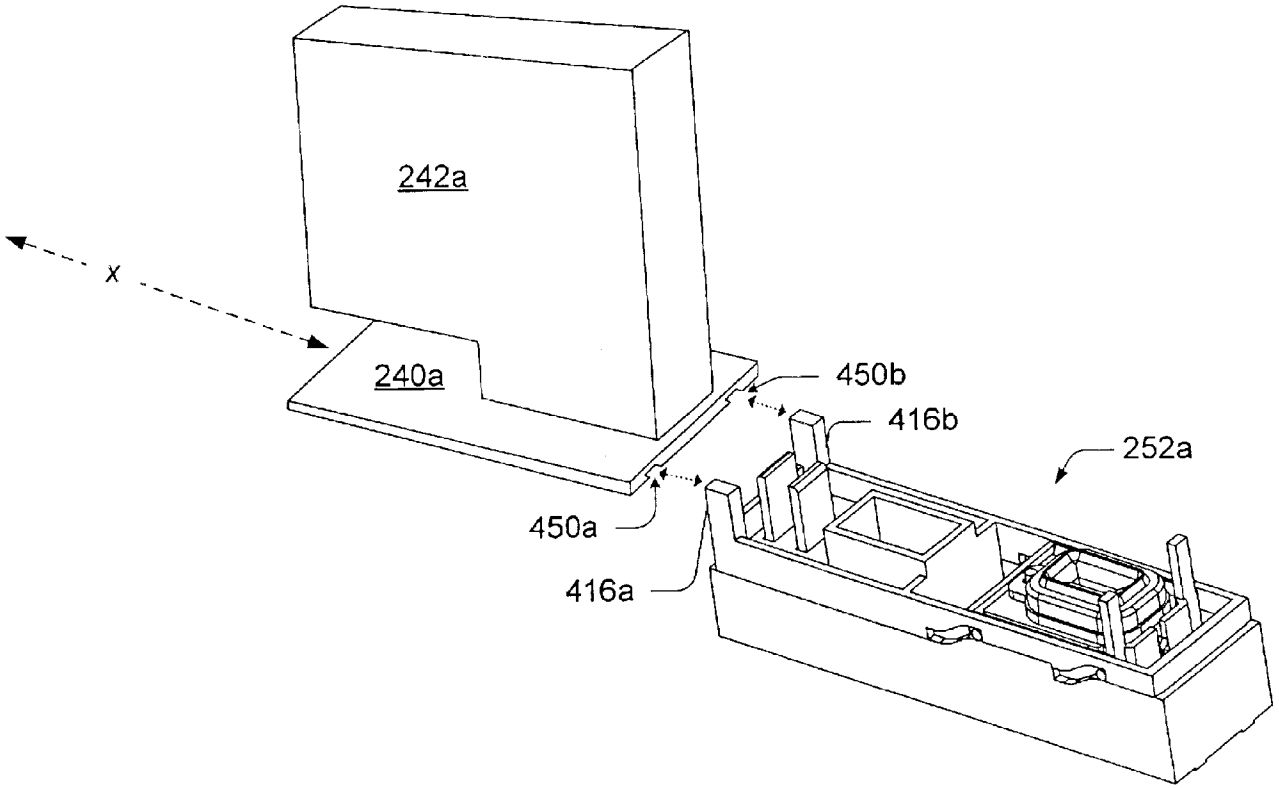
FIG. 4 illustrates an exemplary cleaning unit in accordance with one embodiment.

FIGS. 3–3*a* and 4 show an exemplary modular cleaning unit 252 that can function as a servicing means for servicing a print cartridge in accordance with one embodiment. In this embodiment, the cleaning unit 252 comprises a wiping component 254, a spitting component 256, and a capping component 258 that are in this embodiment arranged along a long axis x of the cleaning unit, though they can be arranged in other configurations and/or along other axes. The cleaning unit 252 has a housing that in this embodiment comprises a top cover 400 and a bottom cover 401.

In this embodiment, the wiping component 254 comprises two wiper blades 402*a* and 402*b*. The capping component 258 comprises a cap 403, a cap base 404, a cover 405, a spring 406, a pivot 408, and one or more engagement structure(s) 410 for engaging a print cartridge. Cam rods 412 which ride within associated cam slots 414 in the top and/or bottom cover may ramp or "cam" the capping component 258 vertically as will be discussed in more detail below.

Alignment structures 416*a* and 416*b* may be utilized to aid alignment of a print cartridge relative to the cleaning unit. FIG. 4 shows one such example where the alignment structures (416*a* and 416*b*) may be received in corresponding slots 450*a* and 450*b* in a print stall 240*a* to provide improved alignment between a print cartridge 242*a* and the cleaning unit 252*a* for servicing the print cartridge. Other suitable embodiments may utilize the alignment structures in various other configurations to improve alignment between a print cartridge and a cleaning unit for servicing of the print cartridge.

Returning to FIGS. 3 and 3*a,* wiper blades 402*a* and 402*b* are configured to clean the exposed surface 247 of the print head 244 (shown FIG. 2*a*) and may be constructed of any suitable flexible material. Exemplary materials from which the wiper blades 402*a* and 402*b* may be formed include, but are not limited to ethylene propylene diene monomer (EDPM) and silicon rubber among others.

The spitting component or spittoon 256 may receive ink ejected or "spit" from a print cartridge's firing nozzle(s) 246 (shown FIG. 2*a*) that is not intended for printing, but instead to improve print quality by clearing the firing nozzle(s). The spitting component 256 may be any suitable shape, such as dish-shaped, and may be configured with an absorbent material lining its bottom to absorb ink. The spitting component 256, as shown in FIGS. 3 and 3*a,* is molded into the top cover 400, though other suitable configurations will be recognized by the skilled artisan.

The spitting component 256 may have a capacity suitable for the intended use of the printing device in which it is employed. Printing devices that are configured for intermittent printing may utilize a larger capacity spitting component 256 than other printing devices that run generally continuously.

The useful capacity of the spitting component 256 may be increased by spitting in various locations of the spitting component rather than positioning the print cartridge in exactly the same place each time spitting is conducted. Stalagmites of dried ink may prematurely cause the spitting component to require servicing or replacement before it has actually reached its holding capacity. Problems associated with stalagmite formation may be mitigated by, among other ways, varying the location of the spit ink and/or by including a leveler in the spitting component 256 to knock down any such build up.

The capping component 258 may function to seal the print cartridge's print head 244 (shown FIG. 2) to reduce desiccation of ink in the firing nozzles 246 (shown FIG. 2). Specifically, when a printing device is not printing, ink may dry in the firing nozzles and form a plug which may block some or all of the firing nozzles and cause a malfunction. During periods when printing is not taking place, the capping component 258 may seal around a portion of the print cartridge containing the print head to reduce air exchange around the firing nozzles 246 (shown FIG. 2*a*) and thereby slow the drying process.

FIG. 3*a* shows an exploded view of the cleaning unit 252 shown in FIG. 3. This view allows some of the elements comprising the cleaning unit to be seen in a little more detail.

The capping component 258, shown in FIG. 3*a,* comprises the cap 403 for sealing around a print cartridge. The cap 403 is positioned by a cap base 404. The cover 405 is positioned adjacent the cap base 404 and is urged against the cap base by a spring 406 that is biased against and held by the pivot 408.

In this embodiment, the cover 405 is formed from Mylar which is advantageously easy to assemble, though other suitable materials may be used. Though not shown, a small channel in the cap base 404 may allow air to escape during capping of a print cartridge. This configuration may advantageously reduce the chance of air being forced up into the firing nozzles of the print cartridge during capping.

The pivot 408 is further configured to allow the cap 403 and cap base 404 to gimbal so that the cap may rotate slightly to align with the print head. Such a configuration provides desirable sealing characteristics between the cap 403 and the print cartridge, especially if there is any misalignment of the print cartridge 242 (shown FIG. 2) relative to the cap 403.

As may be best appreciated from FIG. 3, the capping component 258 is configured to ramp or cam upwardly when contacted by a print cartridge or print cartridge assembly (described below). A print cartridge, such as print cartridge 242 (shown in FIG. 2), may travel along or parallel to the cleaning unit's long axis x, as shown in FIG. 3 and may contact one or more engagement structures 410 of the capping component 258.

The contact between the print cartridge 242 (shown in FIG. 2) and the cleaning unit 252 may move the capping component 258 in the x direction with the print cartridge. Such movement may also cause the capping component to move in a z direction (orthogonal to the x axis) by the action of cam rods 412 which ride within associated cam slots 414 defined by top and bottom covers 400 and 401, respectively. The combination of cam slots 414 and cam rods 412 allow single axis movement of the print cartridge and/or cleaning unit 252 in the x direction to be converted into a two axis movement of the capping component 258 along the plane xz so that the capping component engages the print cartridge and seals the firing nozzles. When the print cartridge separates from the capping component 258 by reversing its path in cam slots 414, generally along the x axis, the capping component 258 may be returned to its initial position by a return spring (not shown) contained in the cleaning unit 252. Moving the capping component 258 in the xz plane facilitates an improved seal between the cap 403 and the print head 244 (shown in FIG. 2*a*).

Though not specifically shown here, the top cover 400 and/or bottom cover 401 may be configured to allow individual modular cleaning units 252 to be coupled with one another and/or with a common structure so that a plurality of cleaning units may comprise a service station 250.

The described components of the cleaning unit 252 may be molded from polymers and/or other suitable materials as will be recognized by the skilled artisan. By way of example, the springs, such as spring 406 also may be made of steel.

Figure 5:
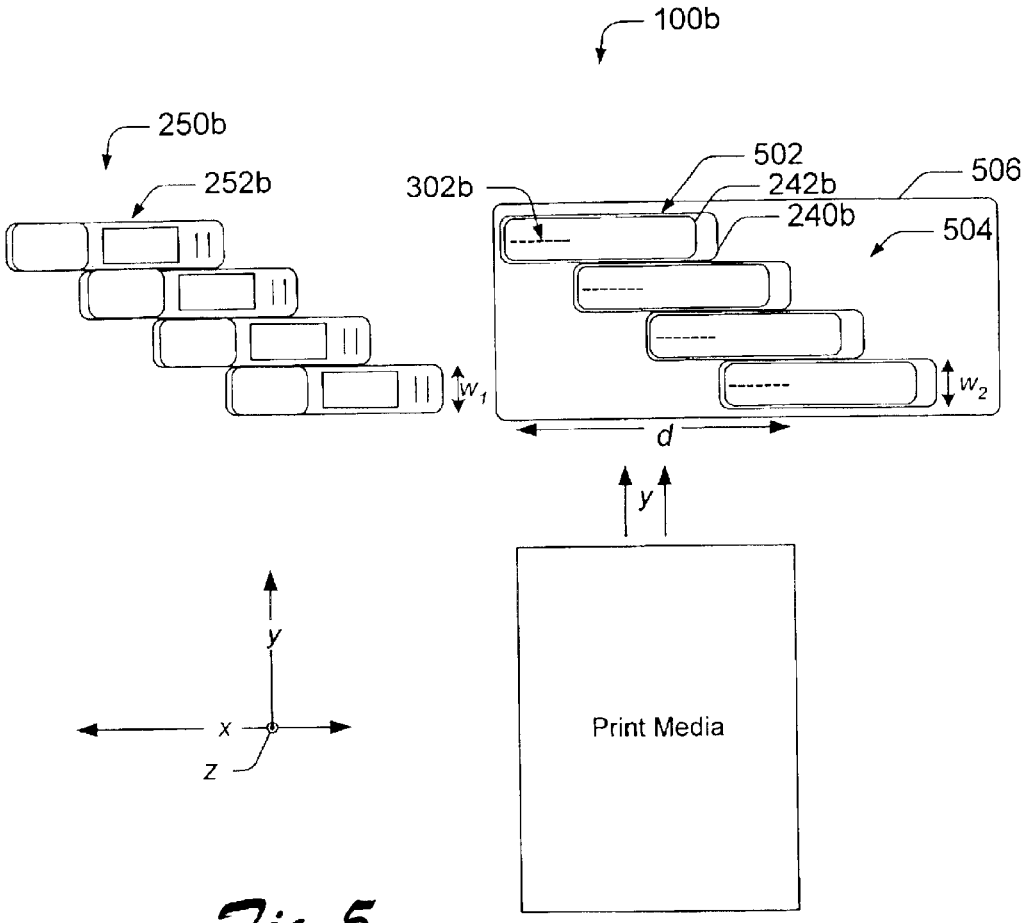
FIG. 5 illustrates an exemplary printing system in accordance with one embodiment.

FIG. 5 shows an exemplary printing system which, in this embodiment, comprises a portion of an exemplary printing device 100*b*. The printing device includes a plurality of print cartridges 242*b*. In this example, four print cartridges are provided, although other embodiments may comprise fewer or more print cartridges. By way of example, each print cartridge 242*b* has a single generally linear nozzle array 302*b*.

Figure 5A:
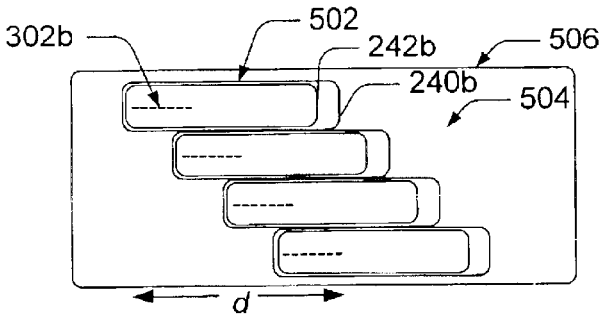
FIG. 5*a* illustrates an alternative embodiment of a portion of the exemplary printing system shown in FIG. 5.

Individual print cartridges 242*b* are positioned by individual print stalls 240*b*. In this embodiment, a print cartridge 242*b* and a print stall 240*b* may comprise a print cartridge assembly 502. Multiple print cartridge assemblies 502 may be positioned relative to one another to form an offset array 504 in a staggered, or stair-step configuration. The print cartridges 242*b* and/or print cartridge assemblies 502 may be positioned relative to one another on a base plate 506. In this embodiment, the print cartridges 242*b* are disposed generally parallel to one another and perpendicular to a paper feed axis y. The nozzle array 302*b* of the individual print cartridges 242*b* may be staggered with no overlap, as shown in FIG. 5, or have slight overlap, as shown in FIG. 5*a*, between the nozzle arrays 302*b* of adjacent print cartridges 242*b* in the direction of the paper feed axis y.

When paper or other print media is fed along the paper feed axis y, the offset array 504 of print cartridge assemblies 502 may be controlled to create a desired print image. The desired print image may have a width as wide as the combined dimension d of the various individual nozzle arrays 302*b* without moving the print cartridge assemblies 502 during formation of the desired image. The combined dimension d may be about "n" times the length l of an individual nozzle array 302 (as shown in FIG. 2*a*.), where "n" is a positive integer that represents the number of print cartridge assemblies 502 in an offset array 504, and the number of cleaning units 252*b*. The multiple nozzle arrays 302*b* shown in FIG. 5 may be controlled by a processor, such as processor 202.

As described above, it may be advantageous to service the print cartridges 242*b* that comprise array 504 using cleaning units 252*b*. As shown in this embodiment, all of the print cartridges 242*b* comprising the array of print cartridges 504 may be serviced simultaneously by a corresponding number of cleaning units 252*b* comprising service station 250*b*. By way of example, four cleaning units 252*b* and four print cartridge assemblies 502 are shown in FIG. 5 (n=4). However, it is to be understood that any suitable number of cleaning units and corresponding number of print cartridge assemblies may be implemented.

Individual cleaning units 252*b* have a width $w_1$ that is equal to or less than a width $w_2$ of an individual print cartridge assembly 502 where the width $w_1$ of the cleaning unit 252*b* and the width $w_2$ of the print cartridge assembly 502 are taken transverse with respect to a long axis of the print cartridge. An example of such a long axis is shown and described in relation to FIG. 2 as the p-axis of the print cartridge 242. In the embodiment of FIG. 5, the long axis of the print cartridges 242*b* can be parallel to the x axis, which is contained in the page upon which the Figure appears and is orthogonal to the paper feed axis y. This configuration can allow cleaning units 252*b* to be positioned close enough together to allow simultaneous servicing of multiple print cartridges 242*b*. By way of example, the width $w_1$ of the cleaning unit 252*b* may be in the range of 26 millimeters (mm) to 30 mm. However, it is to be understood that the width $w_1$ also may be outside the above-referenced range.

The modular cleaning units 252*b* shown in FIG. 5 may be directly coupled to one another to form an array pattern, such as array 504. As will be recognized by the skilled artisan, the number of cleaning units 252*b* may be selected to correspond to a number of print cartridges 242*b* comprising a given printing device.

Figure 6:
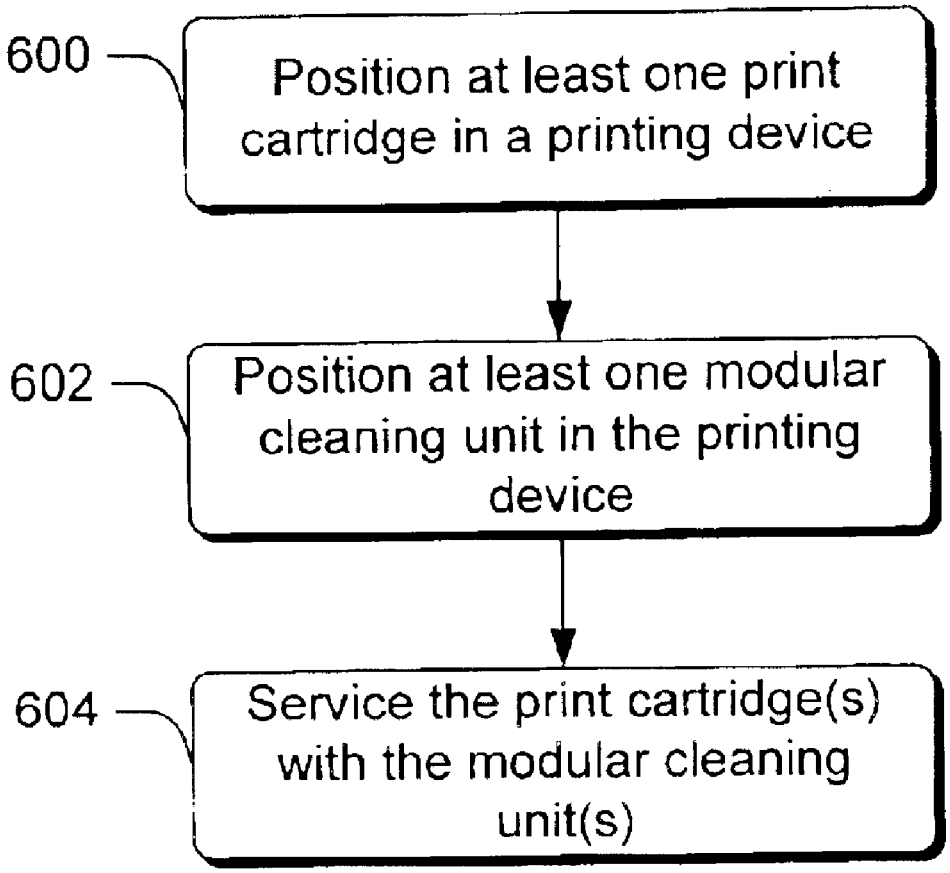
FIG. 6 shows a flow diagram comprising acts in accordance with one exemplary method in accordance with one embodiment.

FIG. 6 shows a flow diagram that describes a method in accordance with one embodiment. The method positions at least one print cartridge in a printing device at 600. In some embodiments, a plurality of print cartridges is positioned in the printing device. Individual print cartridges may be combined with a stall to form a print cartridge assembly that may be positioned in the printing device. In some embodiments, the print cartridges may remain stationary during the formation of the desired print image. The print cartridges may be configured in an offset array that may allow the individual print cartridges to be controlled to cooperatively produce a desired print image that is wider than may be obtained with any individual print cartridge without making multiple passes with the print cartridge relative to the print media.

This exemplary method positions at least one modular cleaning unit in the printing device at 602 to service one or more print cartridges. In some embodiments, multiple modular cleaning units are positioned in the printing device. The cleaning units may be coupled directly to one another in any suitable fashion, i.e. fastening and bonding, among others. Alternatively or additionally, the cleaning units may be coupled to an intermediary structure such a service station. The number of cleaning units may correspond to a number of print cartridges in the printing device.

The method services the print cartridge(s) with the modular cleaning unit(s) at 604. Such servicing may include wiping, spitting and/or capping. In applications with a plurality of print cartridges, a plurality of cleaning units may be coupled to simultaneously service the plurality of print cartridges. Such cleaning unit configurations may be arranged in an offset array. For example, the cleaning units and the print cartridges may be arranged in matching offset arrays, an example of which is shown in FIG. 5.

Simultaneous servicing of multiple print cartridges may be achieved, among other ways, where the cleaning units have a width less than or equal to (i.e.—no greater than) a width of a print cartridge assembly. This configuration may allow multiple cleaning units to be configured in an offset array corresponding to or matching the array of print cartridges.

Such servicing of the print cartridges may be achieved in any suitable manner. For example, a plurality of print cartridges may be simultaneously serviced by moving either the plurality of print cartridges or the plurality of cleaning units relative to the other of the plurality of print cartridges or the plurality of cleaning units to allow servicing of the plurality of print cartridges.

In the embodiment shown in FIG. 5, servicing one or more print cartridges may be achieved by moving either or both of the print cartridge(s) and cleaning unit(s) along the x axis. In some embodiments, multiple print cartridges may be serviced simultaneously.

In one embodiment, the cleaning units may remain stationary while the print cartridges are moved along a single axis to engage the cleaning units. As described above, this movement in a single direction may be utilized to move a capping component of the cleaning units in a second different direction orthogonal to the first direction to efficiently cap the print head. Servicing the print cartridges through movement of the print cartridges and cleaning units in only one direction may advantageously simplify the complexity and cost associated with implementing movement in multiple directions. Any suitable means for moving the print cartridges and/or cleaning units may be utilized. One suitable example utilizes a step motor and pulley assembly. Other suitable means will be recognized by the skilled artisan.

Other embodiments may utilize configurations that move the cleaning units and print cartridges in two or more directions relative to one another. For example, in some embodiments where print media transport means, such as belts, move print media under the plurality of print cartridges it may be advantageous to move the print cartridges in the z direction (as indicated in FIG. 5) to allow sufficient clearance for the cleaning units to be moved in the x (shown FIG. 5) direction to service the print cartridges without contacting the transport means. Other suitable embodiments may move the one or both of the print cartridges and the cleaning units either linearly and/or radially to, among others, to achieve servicing.

Although the embodiments have been described in language specific to structural features and/or methodological acts, it is to be understood that the appended claims are not limited to the specific features or acts described.

What is claimed is:

1. A printing device comprising:

a plurality of print cartridges arranged in an array; and, a plurality of modular cleaning units for servicing the plurality of print cartridges, the modular cleaning units being arranged to allow the plurality of print cartridges to be serviced simultaneously.

2. The printing device of claim 1, wherein the plurality of print cartridges are configured to remain stationary during printing.

3. The printing device of claim 1, wherein the array comprises an offset array.

4. The printing device of claim 1, wherein the plurality of modular cleaning units are configured to be moved to the print cartridges to service the print cartridges.

5. The printing device of claim 1, wherein the print cartridges are configured to be moved to the cleaning units for servicing.

6. The printing device of claim 1, wherein individual cleaning units comprise a wiping component, a spitting component, and a capping component.

7. The printing device of claim 6, wherein the wiping component, spitting component, and capping component are arranged along an axis of the cleaning unit.

8. The printing device of claim 1, wherein the cleaning units are arranged in an array configured to receive the plurality of print cartridges for servicing.

9. The printing device of claim 1, wherein individual print cartridges are positioned in a stall to form a print cartridge assembly, and wherein individual modular cleaning units have a width taken transverse a long axis that is less than a width of the print cartridge assembly taken transverse a long axis of one of the individual print cartridges.

10. The printing device of claim 9, wherein the width of an individual cleaning unit is in the range of about 26 millimeters to about 30 millimeters.

11. The printing device of claim 1, wherein individual modular cleaning units comprise a capping component.

12. The printing device of claim 11, wherein the capping component has a mylar cover.

13. The printing device of claim 11, wherein the capping component is pivotable.

14. The printing device of claim 11, wherein an individual modular cleaning unit is configured to ramp the capping component to engage a print cartridge.

15. The printing device of claim 11, wherein the capping component comprises one or more engagement structures for engaging a print cartridge during movement of at least one of the print cartridge and the modular cleaning unit.

16. The printing device of claim 1, wherein individual cleaning units comprise one or more alignment structures for aligning the cleaning unit with a print cartridge for servicing the print cartridge.

17. A printing device comprising:

an offset array of print cartridge assemblies, the offset array of print cartridge assemblies being configured to remain stationary during printing of a desired image individual print cartridge assemblies comprising a print cartridge positioned in a stall, and wherein individual print cartridge assemblies have a first width taken orthogonally to a long axis of a respective print cartridge; and, a service station comprising multiple cleaning units, individual cleaning units having a wiping component for wiping a print cartridge and having a second width as measured orthogonally to a long axis of the cleaning unit which is no greater than the first width.

18. The printing device of claim 17, wherein the multiple cleaning units are arranged in the service station in an offset array corresponding to the offset array of print cartridges assemblies.

19. A method comprising:

positioning a plurality of print cartridges in a printing device in an offset array configuration;

positioning a plurality of modular cleaning units in the printing device; and, simultaneously servicing the plurality of print cartridges by moving at least one of the plurality of print cartridges and the plurality of cleaning units relative to the other of the plurality of print cartridges and the plurality of cleaning units to allow servicing of the plurality of print cartridges.

20. The method of claim 19, wherein the act of servicing comprises moving the cleaning units.

21. The method of claim 19, wherein the act of servicing comprises moving only along a single axis.

22. The method of claim 19, wherein the act of servicing comprises moving the cartridges and the cleaning units closer together.

23. A method comprising:

positioning a plurality of print cartridges in a printing device, wherein the print cartridges are positioned to collectively create an imaging swath greater than that which may be achieved by any individual print cartridge; and, simultaneously servicing the plurality of print cartridges with a plurality of modular cleaning units.

24. The method of claim 23, wherein the act of servicing comprises one or more of: wiping, spitting, and capping.

25. The method of claim 23, wherein the act of positioning comprises positioning a plurality of print cartridges in an offset array configuration.

26. A printing device comprising:

means for creating a desired image by ejecting ink from multiple distinct image forming means positioned in an offset array; and, means for simultaneously servicing the multiple distinct image forming means by moving at least one of the image forming means and the servicing means relative to the other of the image forming means and the servicing means.

27. One or more computer-readable media having computer-readable instructions thereon which, when executed by a printing device, cause the printing device to:

eject ink from an offset array of print cartridges; and, simultaneously service the print cartridges with multiple cleaning units by moving at least one of the print cartridges and the multiple cleaning units relative to the other of the print cartridges and the multiple cleaning units.

28. A printing device comprising:

multiple print cartridge assemblies arranged in an array, individual print cartridge assemblies comprising a print cartridge positioned in a stall, individual print cartridge assemblies having a first width measured orthogonally to a long axis of a respective print cartridge; and, multiple modular cleaning units configured to service the multiple print cartridge assemblies, individual modular cleaning units comprising a housing and wherein the housing has a second width as measured orthogonally to a long axis of the cleaning unit that is no greater than the first width.

29. The printing device of claim 28, wherein the housing supports two or more of a wiper, a spittoon, and a capping unit configured to service an individual print cartridge.

30. The printing device of claim 28, wherein the second width is less than the first width.

* * * * *